US005959399A

United States Patent [19]

Arimoto et al.

[11] Patent Number: 5,959,399

[45] Date of Patent: Sep. 28, 1999

[54] IMAGE DISPLAY APPARATUS WITH FLAT SCREEN

[75] Inventors: Nozomu Arimoto, Osaka; Takami Okamoto; Mutsuo Masuda, both of Kyoto; Hideaki Maki, Osaka; Atsushi Suzuki; Tsutomu Utsumi, both of Kyoto; Tetsu Ebihara; Junichi Taira, both of Osaka, all of Japan

[73] Assignee: Matsushita Electronics Corporation, Osaka, Japan

[21] Appl. No.: 08/922,921

[22] Filed: Sep. 3, 1997

Related U.S. Application Data

[62] Division of application No. 08/636,708, Apr. 23, 1996, Pat. No. 5,743,778.

[30] Foreign Application Priority Data

| | | | |
|---|---|---|---|
| Apr. 24, 1995 | [JP] | Japan | 7-098309 |
| Sep. 14, 1995 | [JP] | Japan | 7-237487 |
| Dec. 27, 1995 | [JP] | Japan | 7-340137 |

[51] Int. Cl.[6] ..... H01J 27/10; H01J 31/00

[52] U.S. Cl. ..... 313/461; 313/466; 313/477 R; 313/479; 313/482

[58] Field of Search ..... 313/408, 461, 313/466, 473, 474, 476, 477 R, 478–79, 482; 358/245, 246, 247

[56] References Cited

U.S. PATENT DOCUMENTS

| | | |
|---|---|---|
| 2,075,667 | 3/1937 | Sherts . |
| 2,236,046 | 3/1941 | Watkins . |
| 4,739,412 | 4/1988 | Lee . |
| 4,866,338 | 9/1989 | Ishigaki et al. . |
| 4,930,015 | 5/1990 | Dougherty et al. . |

FOREIGN PATENT DOCUMENTS

| | | |
|---|---|---|
| 60-047352 | 3/1985 | Japan . |
| 61-142631 | 6/1986 | Japan . |
| 3-297035 | 12/1991 | Japan . |
| 6-020598 | 1/1994 | Japan . |
| 6-124665 | 5/1994 | Japan . |
| 1 513 809 | 6/1978 | United Kingdom . |

OTHER PUBLICATIONS

Jos Rijnders, et al., "Colour Monitor Tubes with ARAS Coatings", *Electronic Components & Applications*, vol. 10, No. 2, pp. 85–89. Jan. 1, 1990.

*Primary Examiner*—Sandra O'Shea
*Assistant Examiner*—Mack Haynes
*Attorney, Agent, or Firm*—Merchant & Gould P.C.

[57] ABSTRACT

After adhesive resin is applied to a surface of a flat panel, a front panel is glued thereto. One side of the front panel is contacted to the adhesive resin layer with the front panel tilted toward the surface of the flat panel. Then, the front panel is moved slowly to be close and parallel to the front panel. Finally, the front panel is pressed to the surface of the flat panel. Afterward, the adhesive resin is hardened. It is preferable that the thickness of the adhesive resin applied to the surface of the flat panel is decreasing from the side to which the side of the front panel is contacted, to the opposite side. By the above-mentioned method, an image display apparatus having multilayer structure comprising of a flat panel for displaying image, an adhesive resin layer and a front panel can be manufactured efficiently.

6 Claims, 11 Drawing Sheets

IMAGE DISPLAY APPARATUS WITH FLAT SCREEN

This is a Divisional of application Ser. No. 08/636,708, filed Apr. 23, 1996, U.S. Pat. No. 5,743,778 which application(s) are incorporated herein by reference.

FIELD OF THE INVENTION

This invention relates to an image display apparatus having multilayer structure comprising a flat panel, an adhesive resin layer and a front panel, and a method of manufacturing the same.

BACKGROUND OF THE INVENTION

Examples of conventional image display apparatus include cathode ray tubes, liquid crystal panels and a plasma displays. In general, a cathode ray tube has a curved-shaped image display screen. However, a cathode ray tube having a flat image display screen which provides an image display with high resolution and less distortion over the whole screen are used as computer displays and the like. Many of the front panels which are layered on the flat panel through an adhesive resin layer serve not only a reinforcement function for the image display screen but also an anti-reflection function against outside light and an anti-static function. In general, an image display apparatus having multilayer structure comprising a flat panel, an adhesive resin layer and a front panel is manufactured as follows. First, spacers are placed at a flat panel portion, a front panel is placed on the flat panel, and the gap at the periphery between the flat panel and the front panel is sealed by using resin tape or resin for sealing having a high viscosity. The gap at the periphery between the image display screen and the front panel is filled by injecting adhesive resin having a low viscosity from an opening that is formed in the periphery of the flat panel and the front panel. Then, the adhesive resin is hardened, and as a result, an image display apparatus having multilayer structure comprising a flat panel, an adhesive resin layer and a front panel is manufactured. (For example, refer to Japanese Un-examined Patent Publication NO. Hei 6-20598.)

However, the above-mentioned manufacturing method has following problems and is required to be improved.

First, in a method for sealing a gap between the flat panel and the front panel by using a resin for sealing having a high viscosity, a step of hardening resin by irradiating ultraviolet rays or heating that usually needs 30 to 90 minutes is required twice for the sealing-resin and the adhesive resin.

Second, in sealing, the image display screen has to be maintained horizontally. However, in injecting adhesive resin in a gap at the periphery between the flat panel and the front panel, the image display screen has to be tilted. Therefore, in attaching the front panel to the flat panel of the image display apparatus, two kinds of structures, maintaining the image display apparatus horizontally and maintaining the image display apparatus in a position tilted at a certain angle are required.

On the other hand, in a method for sealing a gap at the periphery between the flat panel and the front panel by using resin tape, sealing is not completed sufficiently, and the adhesive resin might leak out before hardened.

In addition to that, there are the following problems concerning production efficiency that apply to both of the above-mentioned methods. First, it takes a long time to inject adhesive resin in a narrow gap that is formed between the flat panel and the front panel. Second, bubbles are easily formed in the adhesive resin layer. Third, control of the viscosity of the resin is required strictly for the resin to be filled completely in the whole area.

SUMMARY OF THE INVENTION

In order to solve the above-mentioned problems, this invention aims to provide an image display apparatus having multilayer structure comprising a flat panel, an adhesive resin layer and a front panel and a method of manufacturing the same efficiently. According to the image display apparatus of the invention, contamination caused by the adhesive resin, and defective qualities such as deterioration, discoloration, and peeling of the adhesive resin do not tend to occur.

According to the invention, an image display apparatus having multilayer structure comprising a flat panel, an adhesive resin layer and a front panel is provided. The above-mentioned multilayer structure is formed by forming the adhesive resin layer on the surface of the flat panel and then gluing the front panel thereto.

In addition to that, the invention provides a method for manufacturing an image display apparatus having multilayer structure comprising a flat panel, an adhesive resin layer and a front panel, the method comprising a step of applying adhesive resin to the surface of the flat panel, a step of gluing the front panel to the adhesive resin layer and a step of hardening the adhesive resin.

According to the present image display apparatus and the method of the manufacturing the same, the above-mentioned problem, which is caused by injecting adhesive resin in a narrow gap between the flat panel and the front panel are facing each other through the spacer does not occur.

It is preferable that in gluing the front panel to the adhesive resin layer, one side of the front panel which is tilted toward the flat panel and is contacted to the adhesive resin layer. Then the front panel is tilted gradually to become parallel to the flat panel and then the front panel is pushed toward the flat panel. According to the above-mentioned method, bubbles are not easily formed in adhesive resin layer between panels and the formed bubbles are escaped from the gap of the panels easily with excess adhesive resin.

It is also preferable that, in applying the adhesive resin, the thickness of the adhesive resin layer decreases from the one side to which the side of the front panel is first contacted to the opposite side, so that the formed bubbles do not remain between panels.

It is also preferable that the step of applying adhesive resin is performed at a temperature that is higher than room temperature so as not to cause peeling of adhesive resin after hardening, or under a condition in which the temperature of the surface of the flat panel is maintained between 30 to 50° C. Further, an ultraviolet ray hardening resin or heat hardening resin may be used as the adhesive resin.

It is also preferable that a pressing plate having a circular or an oval shape is used to press the flat panel to the front panel. The pressing of the front panel is intended to remove formed bubbles from the gap between the panels and obtain the predetermined thickness for the adhesive resin layer. Further, in pressing the front panel to the flat panel, the pressing plate having a rectangular shape which is same as that of flat panel or front panel may be used, however, a more uniform thickness of the adhesive resin layer can be obtained by using a pressing plate having a circular or an oval shape.

In particular, it is preferable that an image display apparatus comprising a cathode ray tube has a construction as follows.

The image display comprises a cathode ray tube comprising a bulb having a flat glass panel portion, a flat shadow mask which is formed facing the inner side of the flat glass panel portion and a reinforcement band that is fixed at the periphery of the flat glass panel portion.

The flat glass panel portion is formed integrally with a flat panel for displaying an image and a glass wall portion that is formed perpendicularly from the edge of the flat panel to connect with the funnel portion.

The above-mentioned flat shadow mask is supported with tension by a frame which is attached removably to an inner side of the glass wall portion.

The above-mentioned structure of the cathode ray tube is preferable not only for the manufacturing method in which a front panel is attached to after the adhesive resin layer is formed on the surface of the flat panel, but also for the strength of the image display screen having a flat surface. That is, the flat panel and glass wall portion are formed integrally and the glass wall portion is connected to the funnel portion. As a result, the breaking strength of the connected portion is much stronger with respect to the pressure that is applied to the image display screen from outside than in the case which the periphery of the flat panel is connected with the funnel portion directly. In addition, the mechanical strength with respect to the pressure from outside is improved by a reinforcement band which is fixed at the periphery of the glass panel portion (glass wall portion).

It is also preferable that the above-mentioned reinforcement band is extended from the surface of the flat panel. By use of the above-mentioned extruded reinforcement band, in applying adhesive resin to the surface of the flat panel, leak of the adhesive resin of the glass wall portion is prevented.

It is also preferable that a reservoir is formed for the adhesive resin which is leaked from the periphery of the front panel is formed in the periphery of flat panel along with protection means covering the exposed portion of the reservoir for the adhesive resin.

It is preferable that the above-mentioned front panel (or adhesive resin layer) has enough conductivity for preventing the flat panel from being charged and also has a function is preventing reflection of outside light (including a function to diffuse reflection).

In a method of gluing the front panel to the adhesive resin layer, it is preferable that, before a step of applying adhesive resin to the surface of the flat panel, a reinforcement band is fixed at the periphery of the flat panel and extended from the surface of the flat panel. The surface of the flat panel is polished, the surface to which the front panel is attached is finished, and a wall for prevention of leak of adhesive resin is formed around the reinforcement band extended from the front edge of the reinforcement band.

In addition to that, after the step of hardening the adhesive resin, it is preferable that the surface protective sheet of the front panel is removed and a protective treatment to cover the surface of adhesive resin that is leaked from the front panel portion with resin tape is performed. By performing the above-mentioned treatment, an appearance is improved, and deterioration and discoloration of adhesive resin caused by the elapse of time can be prevented.

DETAILED DESCRIPTION OF THE INVENTION

Figure 1:
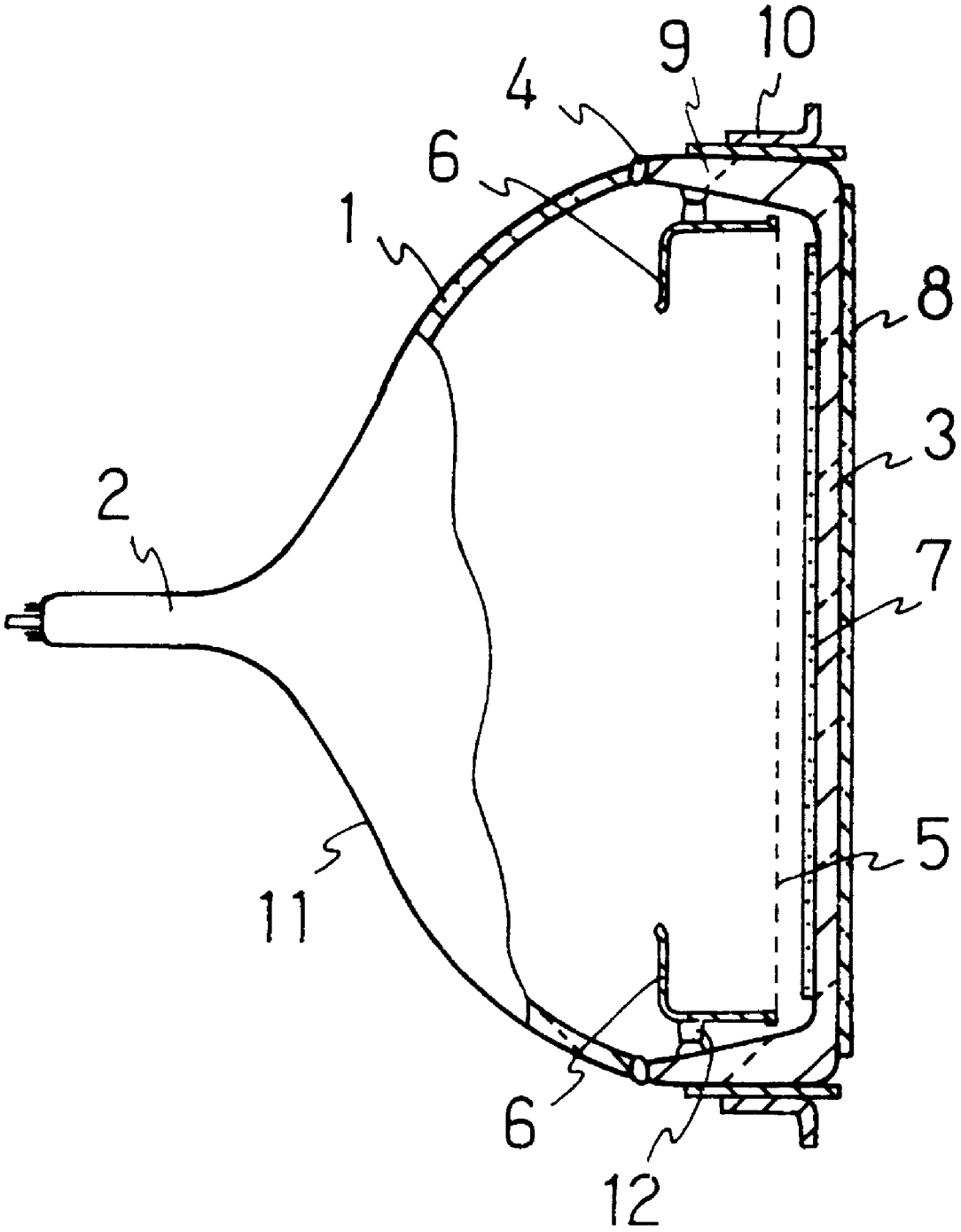
FIG. 1 is a sectional view showing an image display apparatus of the invention seen from the side of the cathode ray tube comprising the image display apparatus.

Referring to the figures, an embodiment of the invention in which a cathode ray tube was used will be described. First, a characteristic of the structure of cathode ray tube of this invention will be explained. As shown in FIG. 1, the cathode ray tube of this invention comprises a bulb 11 having a flat glass panel portion 3 having a flat image display screen, a flat shadow mask 5 that is formed facing an inner side of the flat glass panel portion 3 in the bulb and a reinforcement band 10 that is fixed at the periphery of the flat glass panel portion 3.

Bulb 11 comprises a flat glass panel portion 3 and a funnel 1 comprising a neck portion 2 containing an electron gun (not shown in the figure). The flat glass panel portion 3 is not a flat panel but comprises a glass wall portion 9 that is formed integrally with the flat panel portion 3. The glass wall portion 9 is formed perpendicularly from the edge of the flat panel portion and glued to funnel 1 by using glass adhesive agent 4.

The strength of the bulb 11 is improved by the glass wall portion 9. That is, when the periphery of the flat panel portion 3 is glued to the funnel 1 directly without having a glass wall portion 9, and as a pressure is applied to the flat panel portion 3 perpendicularly, a strong pressure is produced at the attached portion or nearby, and as a result, breaking of the bulb 11 starts from the portion to which the pressure is applied from outside.

On the other hand, as shown in FIG. 1, the image display apparatus of this invention is not easily broken as the glass wall portion 9 absorbs the pressure. The mechanical strength for the pressure from outside is increased by reinforcement band 10 that is fixed at the periphery of the glass wall portion 9.

The flat shadow mask 5 is supported with tension by a frame attached removably to an inner surface of the glass wall by mask spring 12 which are provided at four portions of the periphery of the wall portion 9.

Figure 2:
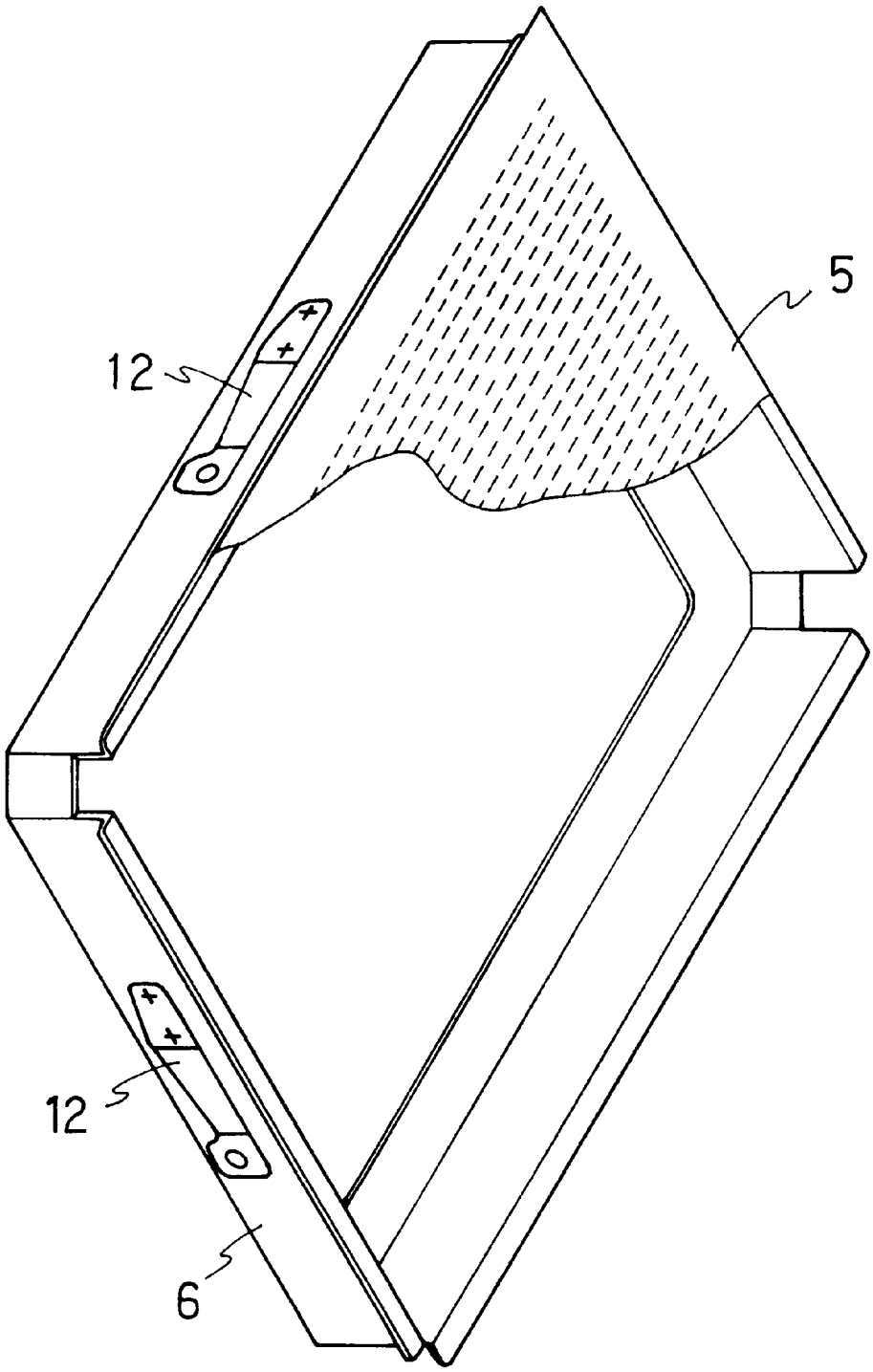
FIG. 2 is a partially exposed perspective view showing a flat shadow mask and a frame which are provided inside of the cathode ray tube as shown in FIG. 1.

FIG. 2 is a portion broken and perspective view showing frame 6 and shadow mask 5 which is supported with tension by a frame 6. The reason why a tension is applied to the shasow mask is as follows.

During operation, when the temperature of the shadow mask 5 is high, even though thermal expansion is generated, flatness of the shadow mask 5 can be maintained by applying the tension to the shadow mask.

In general, the temperature of the shadow mask during operation rises to as high as 100° C. by collision of electron from the electron gun. Therefore, the strength of the tension which is applied beforehand is adjusted to maintain the flatness of the shadow mask 5 at a temperature as high as 100° C. For example, a stress of 5–50 kg/mm$^2$ is applied.

At the inner side of the flat panel portion 3, fluorescent screen 7 is formed for color display. The flat shadow mask 5 is formed facing the fluorescent screen 7, and they are arranged substantially in parallel.

The distance between the flat shadow mask 5 and the fluorescent screen 7 is adjusted within a range of about 2–30 mm. The fluorescent screen 7 can be formed efficiently by attaching a frame removably to inner side of glass wall portion 9 through mask spring 12. That is, after the fluorescent screen is lighted up, an operation of fixing and washing can be performed with the shadow mask 5 removed.

Further, the thickness of flat shadow mask 5 can be thinner than that of the curved-shaped shadow mask, so the pitch of aperture formed in shadow mask 5 can be narrowed. As a result, high resolution can be realized. For example, the thickness of shadow mask 5 can be 0.02 mm, the pitch of the apertures can be 0.25 mm and the diameter of the aperture can be 0.1 mm.

The portion of the flat panel portion 3 on which fluorescent screen 7 Is formed has a substantially uniform thickness. As a result, no difference in optical property is generated between the center portion and the periphery of the image screen. It is preferable that the thickness of the flat panel portion 3 is set within a range of 5 mm to 20 mm.

As shown in FIG. 1, front panel 8 made of transparent glass or transparent resin such as acrylic resin is applied to the surface of the flat panel portion 3. The front panel 8 is placed on the surface of the flat panel portion 3 through an adhesive resin layer having a substantially low degree of hardeness (0.3 mm thickness). That is, an adhesive resin layer having a comparatively low viscosity (about 0.3 mm thickness) is formed on the surface of the flat panel portion 3, and the front panel 8 is placed on the adhesive resin layer. The impact which is applied to the image screen of cathode ray tube from outside is received by the front panel 8 and then is absorbed by the adhesive resin layer. Therefore, an image display screen of bulb 11 can be substantially reinforced by placing the front panel 8 on the front panel portion 3. As a result, a flat panel portion 3 can be thinner than that to which the front panel 8 is not applied.

In addition to that, various kinds of functions can be provided by giving special treatment to the front panel 8. For example, when a front panel 8 is a transparent resin plate, surface hardness can be increased and then anti-scratch property and anti-wear property can be improved so as not to be scratched by sand and dust easily. Further, clearness of the image display can be improved by forming an anti-reflection film that prevents reflection of outside light on the surface of the front panel 8 and by forming minute uneveness on the surface of the front panel 8, which causes diffused reflection.

Further, discomfort for users caused by electrical discharge can be reduced by applying conductivity for preventing the flat panel portion 3 from being charged. The adhesive resin layer may have conductivity. Further, the light transmittance rate and contrast of the image display can be adjusted easier by including additives in the material of the glass or transparent resin of the front panel 8, than by adjusting the light transmittance rate of flat panel 3. As a result, an improvement of the yield of the production of the bulb can be obtained.

Each of the above-mentioned functions serves as an independent function. However, by providing a multilayer film on the front panel 8 or by forming the front panel 8 having multilayer structure, above-mentioned functions can be combined and the combined function can be given to one of the front panels 8.

Figure 3:
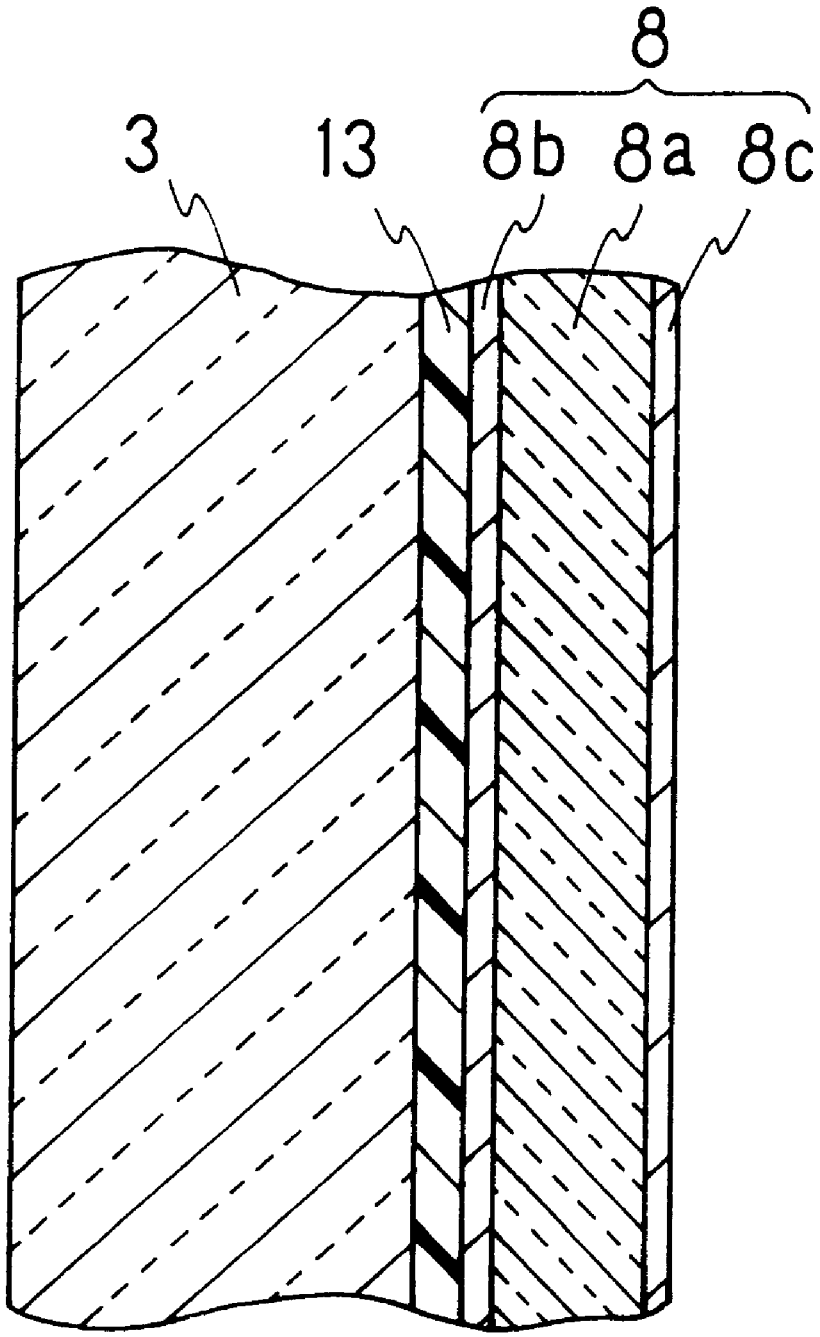
FIG. 3 is a partial sectional view showing a multilayer structure of the image display apparatus including a front panel, an adhesive resin layer and a flat panel comprising conductive film and anti-reflection layer of the cathode ray tube as shown in FIG. 1.

FIG. 3 is a partial sectional view showing front panel 8 having multilayer structure that is glued to the flat panel portion of bulb through adhesive resin 13.

The front panel 8 comprises a panel body 8*a*, a conductive layer 8*b* and a hardened layer 8*c*. Adhesive resin 13 and a method of attaching (gluing) will be explained later.

The conductive layer 8*b* formed inside of panel body 8*a* is made of a conductive material such as stannic oxide ($SnO_2$) and silicon oxide ($SiO_2$) in powder form so as to obtain anti-electrification. It is preferable that the conductive layer 8*b* has at least a $5\times10^{-4}$S/cm conductive ratio so as to have sufficient anti-electrification properties.

It is preferable that the conductive layer 8*b* is connected to the reinforcement band 10 using a conductive tape.

Hardened layer 8*c* is formed on the outer surface of panel body 8*a* by silicon hard contacting treatment, that is by forming a polymer thin film having a siloxane bond, which is similar to the molecular skeleton of glass, so as to increase surface hardness. To more specific, alkoxysilane based composition such as material comprising alkyltrialalkoxysilane or material comprising a silane coupling agent is coated on the surface of panel body 8*a* and dried and heated to hydrolyze and polymerize the alkoxysilane. As a result, hardened layer 8*c* is formed on the outer surface of panel body 8*a*. In order to improve hardness and durability, it is preferable that a mixture of hydrolyzed alkyltrialalkoxysilane and colloidal silica is used to form the hardened layer 8*c*.

The above-mentioned hardened layer 8*c* serves to function not only to improve surfacial hardness of front panel 8 but also as a non-reflection layer. As a result, a phenomenon that the image displayed on the screen appears unclear due to reflection of outside light is prevented or eased.

In order to control the light transmittance of the front panel 8, black dyestuff or pigment is dispersed in panel body 8*a* as an additive. Light transmittance rate having preferable range (for example 90% to 40%) can be obtained by controlling the dispersed condition of the additive.

Further, to given an example, when a thickness of panel body 8*a* is set to be 2.4 mm, conductive layer 8*b* and hardened layer 8*c* having a thickness of about 0.01 mm respectively are obtained.

Further, the conductive layer 8*b* may be formed on the external surface of the front panel 8*a*. In this case, it is preferable that the conductive layer 8*b* is formed between the front panel 8*a* and the hardened layer 8*c* as the conductive layer 8*b* has a high index of refraction, and when the conductive layer 8*b* is formed on the surface of the front panel, mirror reflection is increased and the image display might appear unclear.

Next, a method of mounting the above-mentioned front panel to the flat panel of the bulb through the adhesive resin layer (that is, gluing) will be explained referring to examples and figures.

EXAMPLE 1

Figure 4:
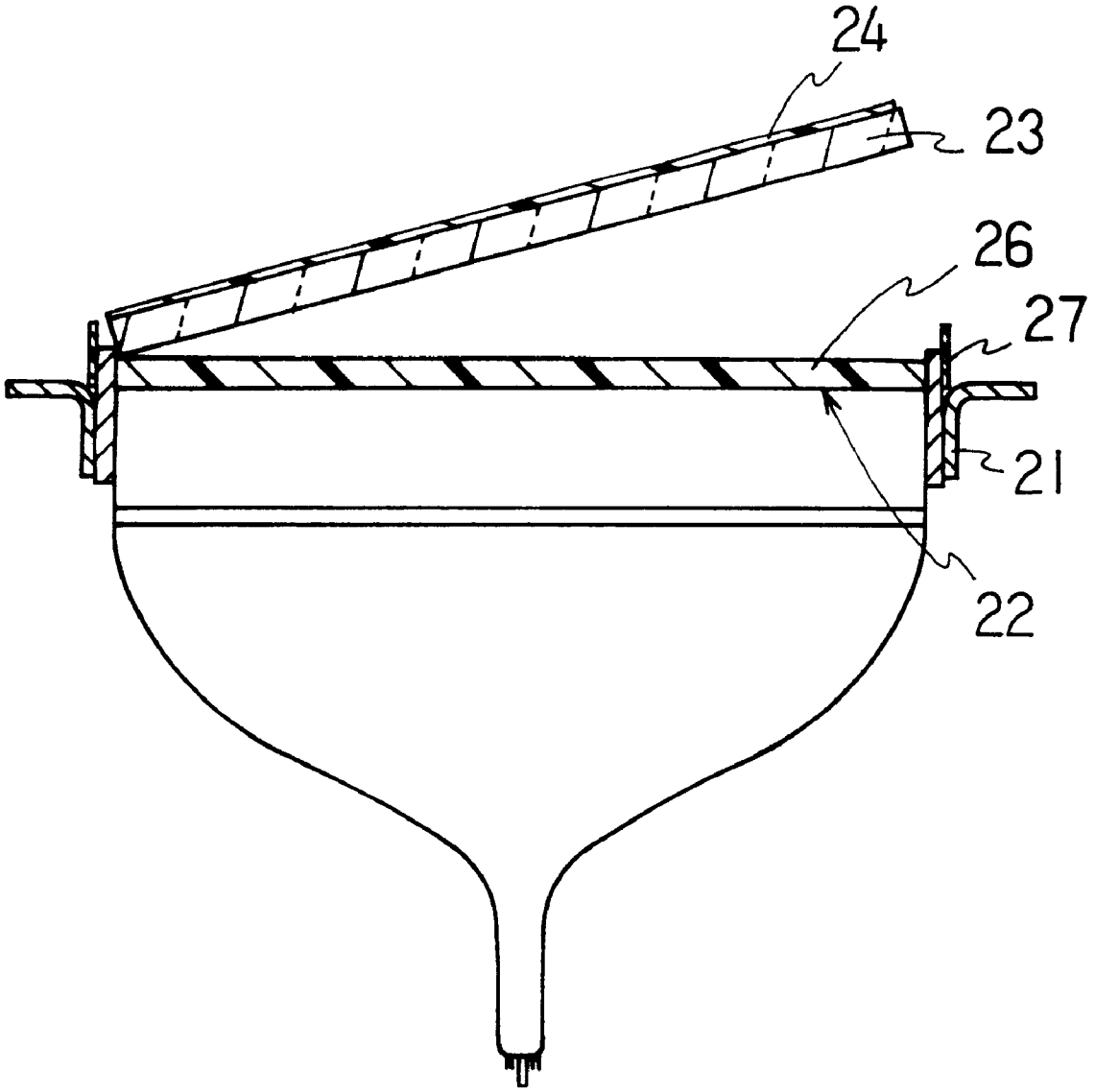
FIG. 4 is a side view of a cathode ray tube showing an example in which a front panel is glued to a flat surface panel portion of a cathode ray tube of this invention.

As shown in FIG. 4, reinforcement band 21 (hereinafter, also described as "shrink band") is fixed at the periphery of the glass wall portion of the bulb by shrink fitting with extended away from the surface of the flat panel of the bulb by a distance of about 2.0 mm.

In conventional image display apparatus, the shrink band is attached to the position which is 5–20 mm below the surface of the flat panel. As above-mentioned, in gluing the front panel 23 (hereinafter, also described as "reinforcement panel") to the flat panel 22, leak of the adhesive resin 26 which is coated with the surface of the flat panel 22 to the periphery of bulb can be prevented and also position of the front panel 23 can be set easily by forming the shrink band 23 with extended from the surface of the flat panel.

Further, an edge of the front panel can be protected from outside impact by the extruded shrink band 21.

Figure 5:
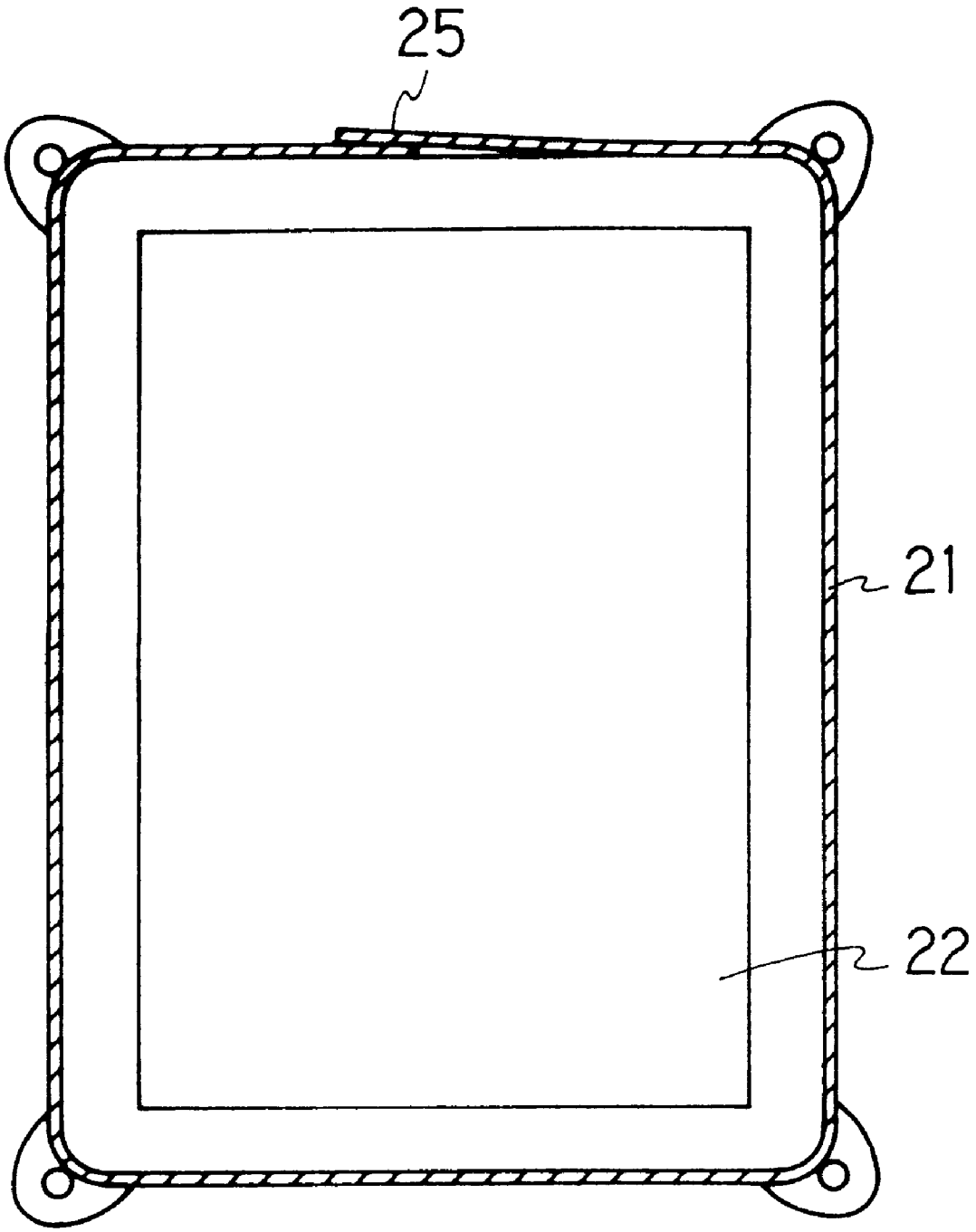
FIG. 5 is a plan view showing an image display apparatus seen from the image display screen of the cathode ray tube as shown in FIG. 4.

Next, the flat panel 22 is polished by using abrasive material such as "CEROX" (brand name) and then surface finish is given and dirt and dust is removed. A surface finish is only given to the adhesive surface of the reinforcement panel 23. Further, beforehand, an ultraviolet-ray transmitting protective sheet 24 (for example, "SPV-224 clear" (brand name) manufactured by NITTO DENKO CORPORATION) is stuck to the surface of the reinforcement panel 23 (opposite side of the adhesive surface). Then, resin tape 27 having about 20 mm width, for example, "poly ester tape No. 31 B" (brand name) manufactured by NITTO DENKO CORPORATION, a film made of polyethylene terephthalate, is stuck around the shrink band 21 and extends 7 mm from the front edge surface of shrink band 21. As a result, a wall that can prevent leakage of adhesive resin 26 is formed. Then, in order to prevent the leak of adhesive resin from the connecting portion of shrink band 25 (referring to the plan figure of FIG. 5), ultraviolet-ray hardening resin having a high viscosity (for example, "UVU-1002S" (brand name) manufactured by SANYO KASEI) is applied to the connection portion to be filled in. Further, the order of the step of filling-in resin and the step of forming wall can be changed, however, by conducting the filling-in step after the step of forming wall, gap between tape 27 consisting of wall and shrink band 21 can be filled in at the same time.

Next, adhesive resin (for example, "UVU-1002" (brand name) manufactured by SANYO KASEI) is applied over the whole surface of the flat panel 22 uniformly. It is preferable that about 0.1 ml/cm$^2$ of resin is used. When adhesive resin is applied to CRT having a diameter of 41 cm, it is preferable that about 80–100 ml of resin is used.

Figure 6A:
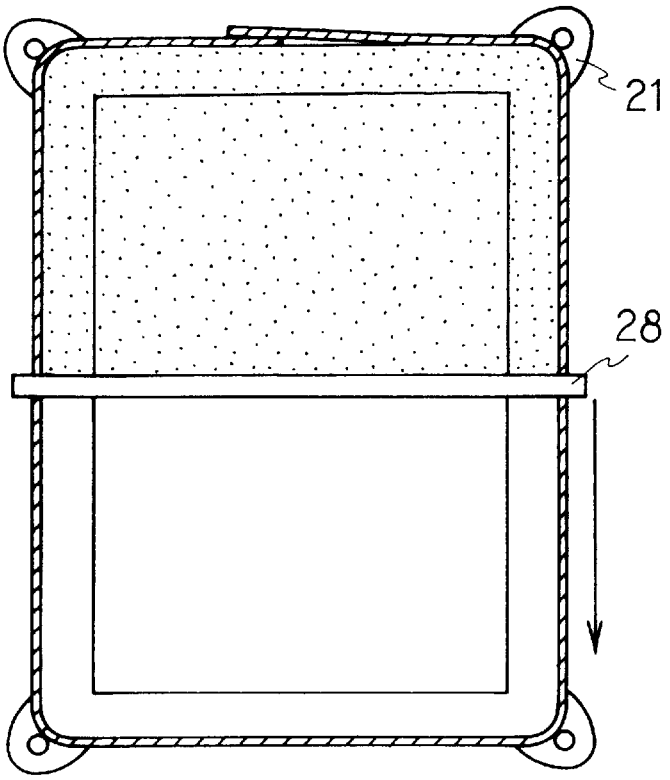
FIG. 6A is a plane view showing a step of applying adhesive resin to the surface of a flat panel in the method shown in FIG. 4.
Figure 6B:
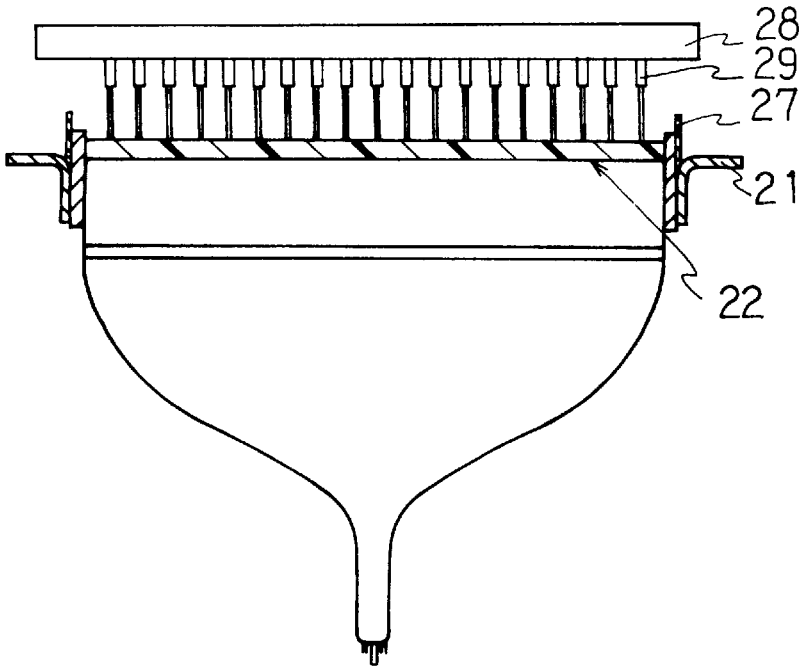
FIG. 6B is a side view showing a step of applying adhesive resin to the surface of a flat panel in the method shown in FIG. 4.

As shown in FIGS. 6A and B, an adhesive resin is applied to the surface of the flat panel. In applying the adhesive resin, nozzle 28 comprising a plurality of outlet tubes 29 having diameter of 2 mm that are connected at intervals of 7 mm, is moved from one of the shorter sides of the surface of the flat panel to the other of the shorter sides at a predetermined speed and then the adhesive resin which is flowed from each outlet 29 is supplied to the surface of the flat panel 22. The thickness of the formed resin which is applied is 0.5–1.2 mm.

Then, as shown in FIG. 4, one side of the reinforcement panel is contacted to the adhesive resin layer with the reinforcement panel tilted toward the surface of the flat panel 22 at an angle of 10–20°. The position of the reinforcement panel 23 on the surface of the flat panel 22 can be determined by contacting one side of the reinforcement panel 23 to the inner wall of the shrink band 21 which extends from the surface of the front panel, and setting both sides of the reinforcement panel 23 along the inner wall of the shrink band 21.

Then, the reinforcement panel 23 is pushed down gradually until the reinforcement panel is parallel to the surface of the flat panel 22. During the above-mentioned operation, bubbles formed in adhesive resin can be released easily by pushing down gradually on the reinforcement panel 23 whose one side is contacted to the adhesive resin layer.

Then, a pressure of 20 kg (19 g/cm$^2$)is applied to the reinforcement panel 23 perpendicularly and maintained for 10 seconds. In the method of this invention, the spacer which is used conventionally is not used. Therefore, it is important that the gap between the surface of the flat panel 22 and the reinforcement panel 23 is rendered uniform by applying pressure uniformly. The above-mentioned gap after the pressure was applied is about 0.3 mm. After that, the adhesive resin was hardened by irradiating with 500–1800 mJ/cm$^2$ of ultraviolet-ray energy.

Finally, the tape 27 that was stuck around the periphery of the shrink band 21 as a wall was removed. When an adhesive resin leaks out from the surface of the reinforcement panel 23, the extra adhesive resin can be removed efficiently by with a cutter along with the tape 27. Further, the extra adhesive resin which was leaked to the reinforcement panel 23 was removed together with the protective sheet 24, and then a step of placing the reinforcement panel (front panel) is completed. Further, when the reinforcement panel 23 has a conductive layer, after the step of placing the reinforcement panel, the reinforcement panel 23 is connected to the shrink band 21 using conductive tape.

In the above-mentioned example, ultraviolet-ray hardening resin was used as the adhesive resin, however heat hardening resin (for example, main resin: "EpiFine 9235" manufactured by Fine Polymers, hardening agent: "EpiFine H-196" manufactured by Fine Polymers ) may be used instead. Further, a method of coating adhesive resin is not limited to the above-mentioned method of this example in which a nozzle having a plurality of outlets is used. A method in which a nozzle having only one outlet is used to apply the predetermined amount of the adhesive resin at the central portion of the flat panel or a method in which a nozzle is moved circularly from the central part to the periphery of the flat panel. However, in applying the predetermined amount of the adhesive resin to the central portion of the flat panel, the viscosity of the resin is required to be low enough so as to cover whole surface and periphery of the flat panel.

In contacting one side of the reinforcement panel to the resin layer with the reinforcement panel tilted toward the surface of the flat panel, less bubbles are produced by contacting the longer side of the reinforcement panel to the resin layer than by contacting the shorter side of the reinforcement panel.

Further, when the reinforcement panel is tilted at less than 10°, bubbles are produced easily. Therefore, it is preferable that the reinforcement panel is tilted at an angle between 10° and 20°.

EXAMPLE 2

Figures 7A, 7B:
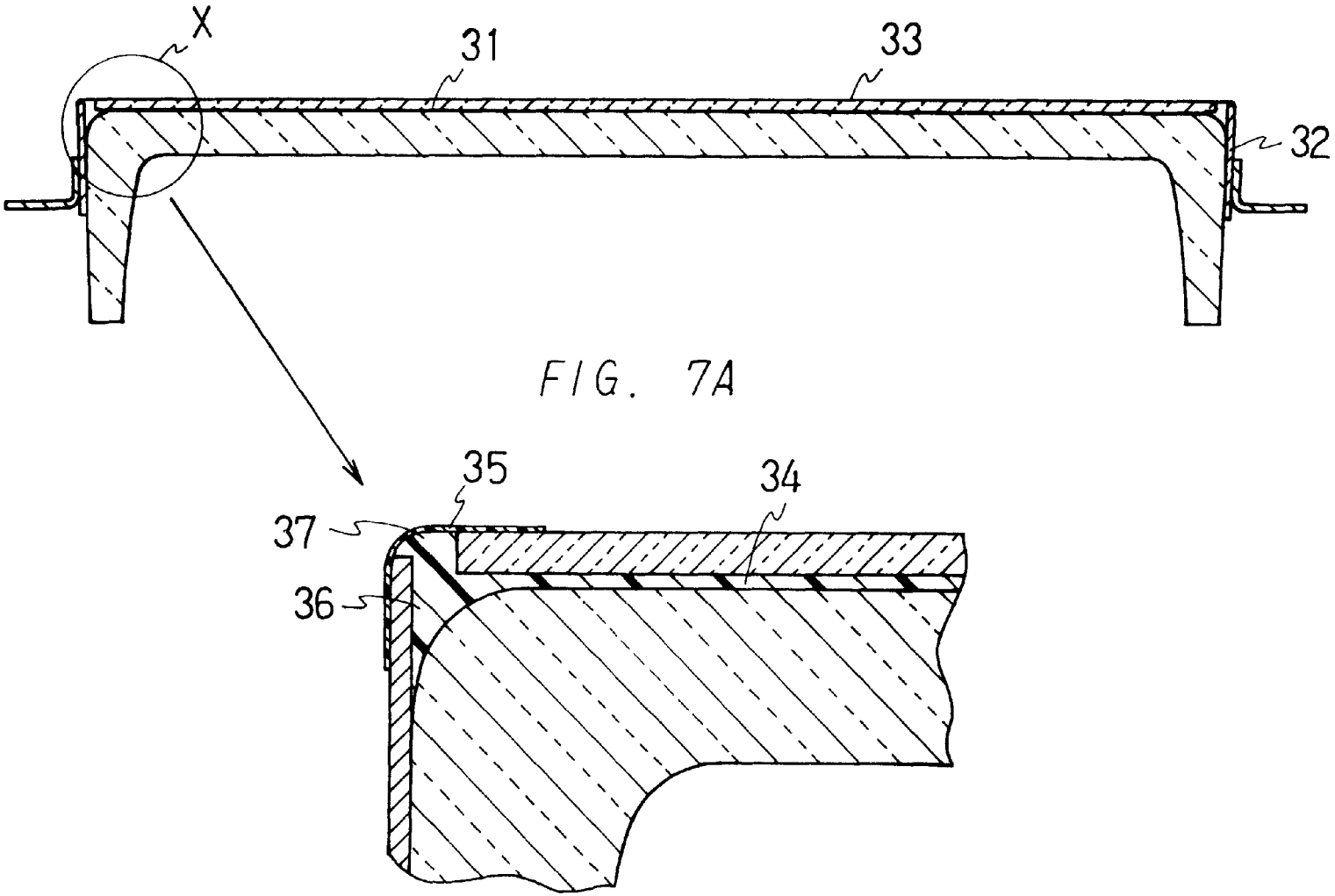
FIG. 7A is a sectional view showing a structure of the periphery of the front panel in gluing the front panel to the flat panel through the adhesive resin layer and an example to improve the treatment.
FIG. 7B is an enlarged sectional view showing a structure of periphery of the front panel in gluing the front panel to the flat panel through the adhesive resin layer and an example to improve the treatment.

Next, an example which is based on Example 1 and whose structure of panel portion and treatment is improved will be explained. FIG. 7 A is a partially sectional view showing a front panel (reinforcement panel) 33 to which the surface of flat panel 31 is glued through an adhesive resin layer. FIG. 7B is an enlarged view of panel 33 portion (X portion). As seen from FIGS. 7A and 7B, reservoir 36 for extra adhesive resin 34 is provided around the periphery of the reinforcement panel 33 and further, resin tape 35 is stuck to cover the exposed portion 37 of the reservoir 36 as a protective cover. When the reinforcement panel 33 is glued to the surface of flat panel 31 by the method of Example 1, the adhesive resin 34 which leaks out from the periphery of the reinforcement panel 33 might be overflowed beyond shrink band 32. In order to prevent the above-mentioned overflow of the adhesive resin, reservoir 36 is provided. In the image display apparatus comprising cathode ray tube of this example, reservoir 36 is formed by the L-shaped curved surface, inner side of shrink band 32 and edge surface of reinforcement panel 33. In the image display of liquid crystal panel and plasma display, a reservoir for adhesive resin can be formed by forming groove in the panel portion. Further, excess adhesive resin 34 that leaks out from the surface of the reinforcement panel 33 can be removed efficiently by with a cutter along with the resin tape.

Further, after the adhesive resin is hardened, the resin tape is stuck to cover the exposed portion 37 of the adhesive resin of reservoir 36 not only to improve the appearance of the image display apparatus, but also to prevent change in color and deterioration of strength of the adhesive resin by direct exposure to the air. An elastic vinyl chloride tape can be used as the resin tape 35. The resin tape 35 is stuck around the periphery of reinforcement panel 33 and front edge portion of shrink band 32, with setting the exposed portion of adhesive resin to the center of the resin tape. A resin tape not only made of vinyl chloride but also made of polyester, polypropylene and cloth can be used. As a protective means to cover for the exposed portion of the adhesive resin, silicon based resin and coating material such as lacquer can be used instead of stucking the resin tape.

EXAMPLE 3

Next, an example which is based on Example 1 and having a structure in which bubbles are not formed easily between the reinforcement panel and the flat panel (adhesive resin layer) will be explained.

Figure 8:
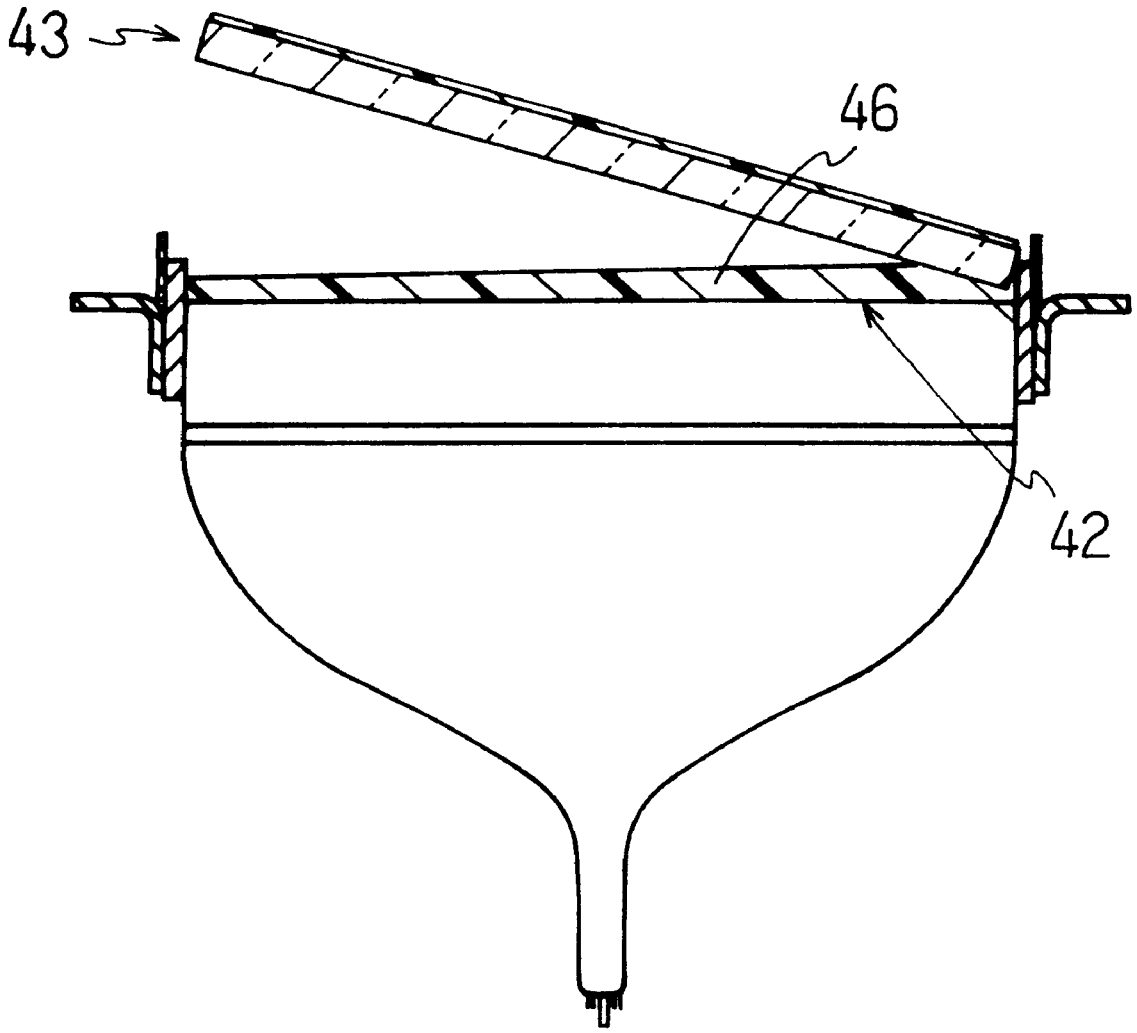
FIG. 8 is a side view of the cathode ray tube showing another example to explain a method of gluing the front panel to the flat panel portion of the cathode ray tube.

As shown in FIG. 8, in applying the adhesive resin 46 to the whole surface of the flat panel 42, the thickness of the adhesive resin layer is changed. That is, as above-mentioned, in contacting the reinforcement panel 43 to the one side of the adhesive resin layer, the thickness of the adhesive resin layer decreases from the side to which the side of the front panel is first contacted to the opposite side. In the step of gluing the reinforcement panel 43 to the surface of the flat panel 42, one side of the reinforcement panel 43 is contacted to the side of the adhesive resin layer having greater thickness with the reinforcement panel is tilted toward the surface of the flat panel 42. Then the reinforcement panel 43 is further tilted gradually toward to become parallel to the surface of the flat panel 42. Compared with the Example 1 in which adhesive resin layer having uniform thickness is applied, in this example, the reinforcement panel 43 can be tilted pressing down the surface of the flat panel 42, therefore, bubbles are not formed easily and formed bubbles can escape from the reinforcement panel 43 with excess adhesive resin. As given an concrete example, 30%–50% of formed foams were trapped in the product when the adhesive resin layer having uniform thickness was used, however, in this example, almost none of formed bubbles were trapped in the product.

Figure 9A:
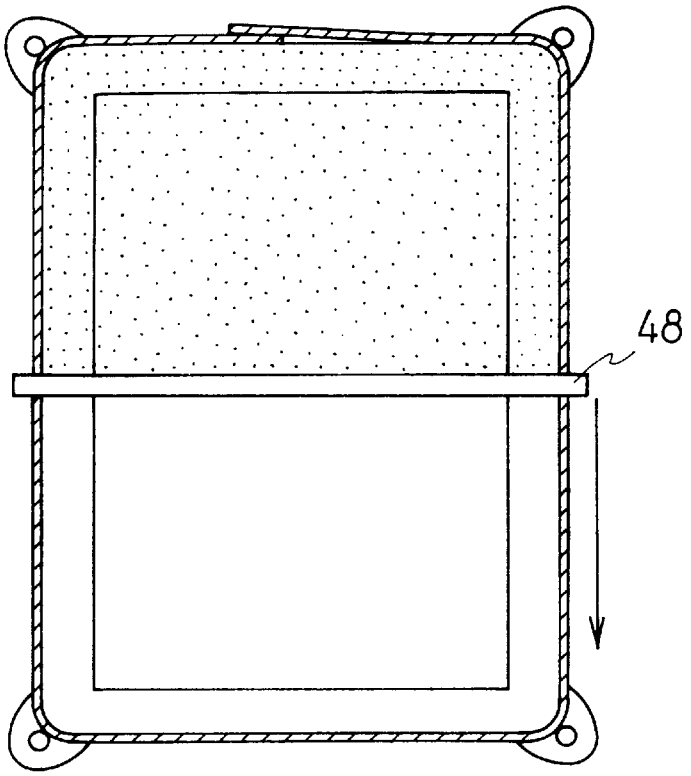
FIG. 9A is a plan view of the cathode ray tube showing a step of applying adhesive resin to the surface of the flat panel in a method as shown in FIG. 8.
Figure 9B:
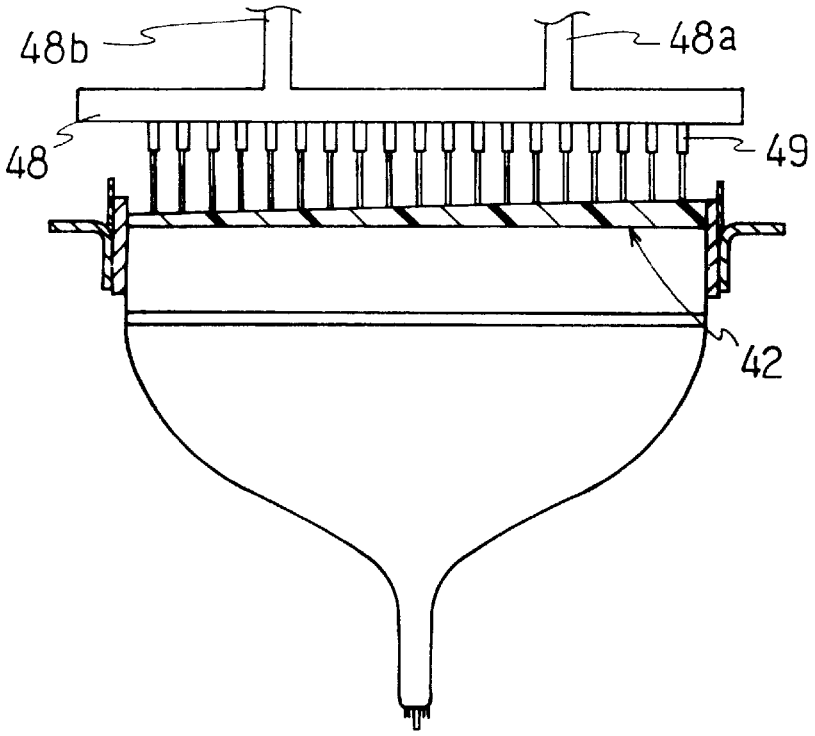
FIG. 9B is a side view of the cathode ray tube showing a step of applying adhesive resin to the surface of the flat panel in a method as shown in FIG. 8.

As shown in FIGS. 9A and B, the adhesive resin layer whose thickness is changed is applied to the surface of the flat panel 42. In the same way as Example 1, the nozzle in which a plurality of (30–50) outlet pipes 49 having a 2 mm diameter are connected is moved from one side of the surface of the flat panel 42 to another side of the surface of the flat panel 42 at a predetermined speed to apply the adhesive resin to the surface of the flat panel 22. Unlike Example 1, resin supplying tubes for pipe 48 are connected to two parts spaced axially along the pipe 48. (Shown in FIG. 9 48*a* and 48*b*)

The amount of resin flowing from each outlet pipe 49 was changed in the axial direction of the pipe 48 by changing the supply amount of resin for the two resin supplying tubes 48*a* and 48*b* (supply pressure) in the axial direction of the pipe 48. As a result, the thickness of the adhesive resin layer that was applied to the surface of the flat panel 42 was changed in the axial direction of the pipe 48.

A method to change a thickness of the adhesive resin layer is not limited to the above-mentioned method. For example, the inner diameter of the outlet pipe 49 that is provided on the side whose thickness of resin is intended to be thicker is made to be bigger than that of the opposite side. In addition to that, pitch between which outlet pipes 49 are connected to the pipe 48 can be changed instead of making them constant (for example 7 mm pitch). That is, on the side having thicker adhesive resin, the pitch between outlet pipes 49 can be narrower than on the opposite side. (In other words, the outlet pipes 49 are connected more densely.) Further, it is preferable that the ratio of thickness of the adhesive resin layer is 7:3 (the side having the thickest thickness of the adhesive resin layer : the side having thinnest thickness of the adhesive resin layer). When the ratio of the thickness of the adhesive resin layer is higher than that, it takes a longer time to press down the reinforcement panel 43 which is tilted toward the surface of the flat panel 42 to become parallel to the surface of the flat panel 42, thus, the efficiency of the operation is reduced. Further, when outlet pipes 49 are connected to the pipe 48 densely, the resin which is flowed out from the outlet pipe 49 is stuck together before the resin is applied to the surface of flat panel, thus, the resin can not be applied to the surface of the flat panel normally. On the other hand, when outlet pipes 49 are connected to the pipe 48 with wider pitch, an area to which the resin is not applied is generated, and thus, bubbles are formed easily between the reinforcement panel 43 and the surface of the flat panel.

EXAMPLE 4

Next, an example which is based on Example 1 and having structure in which the thickness of adhesive resin between the reinforcement panel and the flat panel is uniform and in which peeling of the adhesive resin layer does not occur easily will be explained.

In a step of pressing the reinforcement panel to the flat panel after the reinforcement panel is tilted gradually to the flat panel to be parallel, an improvement of making the thickness of adhesive resin layer uniform is performed. The reinforcement panel is pressed to the flat panel by applying 20–60 kg of pressure perpendicularly for about 10 seconds.

The step of pressing the reinforcement panel to the flat panel is intended to remove bubbles formed between the reinforcement panel and the flat panel (in the adhesive resin layer) with excess resin and to obtain the resin layer having the predetermined thickness. When the resin layer is thick, the display image is seen with distortion and weight of the resin layer is increased. Further, when a reinforcement panel made of float soda lime glass is cracked, shards of glass scatter as the adhesive resin layer serves as spring. It is preferable that the resin layer is thin enough to prevent the scatter of the pieces of glass. To be concrete, it is preferable that the thickness of the resin layer is less than 1 mm. When soda lime glass having a weak strength is used as a reinforcement panel, it is preferable that the thickness of the resin layer is thinner than that, for example, less than 0.3 mm (300 $\mu$m).

Figure 10A:
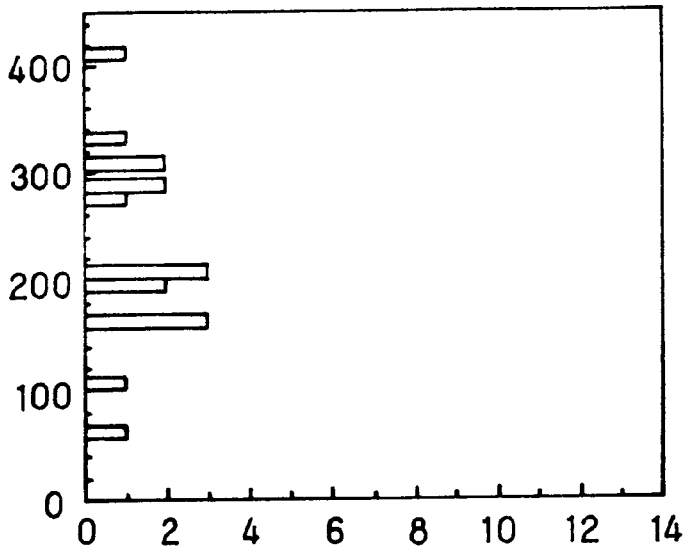
FIG. 10A is a graph showing the distribution of the measured thickness of the resin layer formed by a step of pressing a reinforcement panel to a flat panel in which a rectangular pressing plate is used.
Figure 10B:
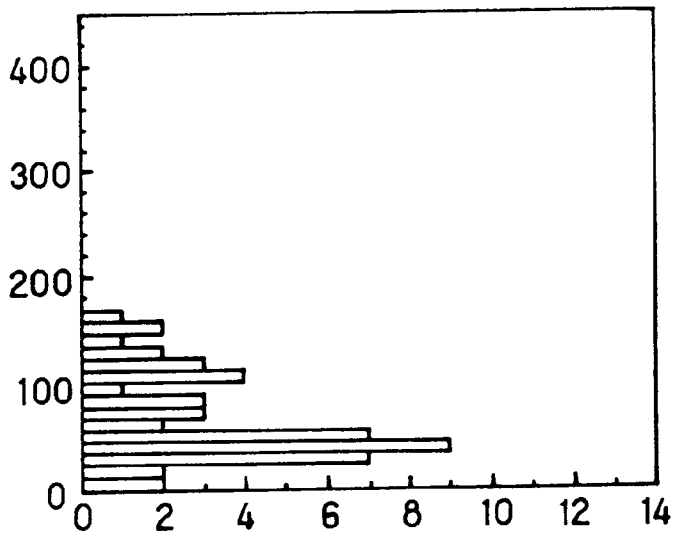
FIG. 10B is a graph showing the distribution of the measured thickness of the resin layer formed by a step of pressing a reinforcement panel to a flat panel in which a circular pressing plate is used.
Figure 10C:
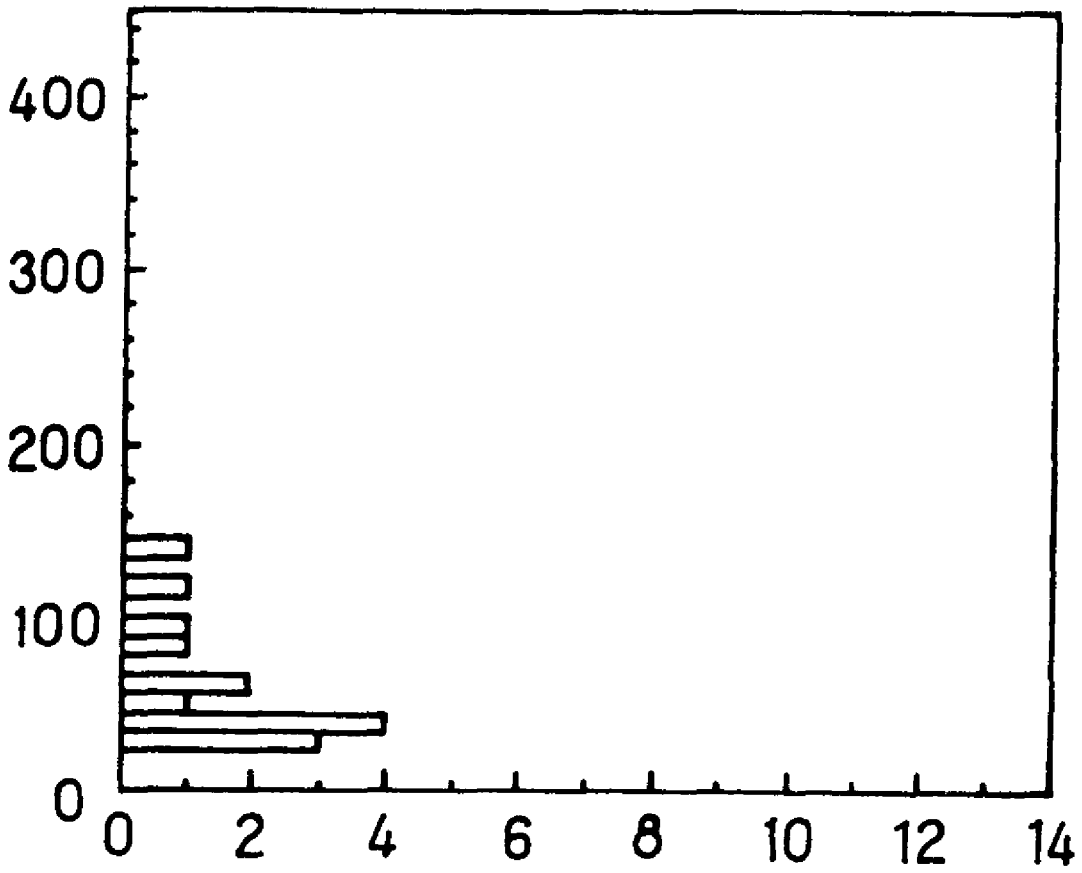
FIG. 10C is a graph showing the distribution of the measured thickness of the resin layer formed by a step of pressing a reinforcement panel to a flat panel in which an oval pressing plate is used.

In order to obtain the resin layer having the above-mentioned thickness effectively, in this example, a pressing plate having a circular shape or an oval shape was used. As a result, the variations of thickness of the resin layer became narrow. Before the method of using a pressing plate having a circular shape or an oval shape, a pressing plate having a rectangular shape which is similar figure of that of reinforcement panel was used. FIGS. 10A, B and C are graphs showing a distribution of measurements which were obtained by using a pressing plate having a rectangular shape, a circular shape or an oval shape. When the pressing plate having a rectangular shape was used, the obtained average thickness of the resin layer was 226 $\mu$m, and variation $\sigma$ was 87 $\mu$m. When the pressing plate having a circular shape was used, the obtained average thickness of resin layer was 67 $\mu$m, and variation $\sigma$ was 41 $\mu$m. And when the pressing plate having an oval shape was used, the obtained average thickness of resin layer was 61 $\mu$m, and variation $\sigma$ was 35 $\mu$m. Further, the rectangular pressing plate having a size of 150×200 mm, the circular pressing plate having a diameter of 160 mm and the oval pressing plate having a size of 100×150 mm (short axis×long axis) were used for a CRT tube having 41 cm in diameter in this example. Further, the reinforcement panel having a size of 292×368 mm was used.

When a small pressing plate is used, a pressure is concentrated on one portion, thus, the adhesive resin layer on this portion is pressed strongly and forced away. As a result, on this portion, the flat panel and reinforcement panel are contacted directly, and an interference fringe pattern is produced to affect the image display adversely. Further, it is important that the reinforcement panel is pressed to the flat surface carefully not to cause tilt and warping of the reinforcement panel. Therefore, it is required to use a pressing plate having a proper size and to press the whole surface of the pressing plate to the reinforcement panel by applying the pressure uniformly. It is possible to press the whole surface of the pressing plate which can be operated flexibly by giving flexibility to the supporting structure of pressing plate. It is preferable that a hard material such as aluminum or teflon resin is used for pressing plate and the pressing plate has a flat surface. Further, it is preferable that rubber material is glued to the pressing surface to prevent a scratch of the surface of the reinforcement panel.

Next, an improvement to prevent peeling of the adhesive resin layer will be explained. According to the above-mentioned reasons, it is preferable that a thickness of the adhesive resin layer is thin, less than 1.00 mm. However, when the adhesive resin layer is thin, peeling of the adhesive resin layer can occur easily. In particular, when a product (for example, an image display apparatus or a computer with which the image display is equipped) is transported, or is stored in the container, the surrounding temperature sometimes rises up to about 70° C., and peeling of the adhesive resin layer often occurs.

In order to prevent the above-mentioned peeling of the adhesive resin layer, in this example, a step of applying adhesive resin to the surface of the flat panel is performed under the condition which is higher than room temperature. According to the result of the test, it is found that, when the adhesive resin was applied to the surface of the flat panel having surface temperature 5–20° C., peeling of the resin occurred at 70–100° C. On the other hand, it was found that, when the adhesive resin was applied to the surface of the flat panel maintaining surface temperature 40–50° C, peeling of the resin occurred at 110° C. or higher.

When the upper limit of temperature is set to be 75° C. for transport and storage of the product, it was found out that peeling and not occur when the adhesive resin was applied to the surface of the flat panel maintained at a surface temperature 30° C. Therefore, in addition to the method of applying the resin at high temperature (30–50° C.), adhesive resin may be applied to the surface of the flat panel after the surface of the flat panel is heated. As a result, when the adhesive resin is applied to the surface of the flat panel maintained at a surface temperature 30–50° C., the above-mentioned effect can be obtained. In the filling step in Example 1, when a heat hardening resin is used as filling resin to prevent the leak of the resin, it is possible to harden the filling resin at the same time in heating the surface of the flat panel.

According to the invention, embodiments applying to the cathode ray tube were explained referring to examples, however, this invention may be applied not only to the cathode ray tube but also to an image display apparatus having a display screen comprised of a flat plate such as plasma display panel (PDP), liquid crystal panel (LCD), EL, vacuum display (VFD) and micro cathode display. When the above-mentioned image display apparatus are applied to the embodiments of this invention, a frame made of resin may be used to form a wall to prevent the leak of the adhesive resin instead of using shrink band which is used for the cathode ray tube.

What is claimed is:

1. An image display apparatus having a multilayer screen comprising a flat panel, an adhesive resin layer and a front panel, wherein the multilayer screen is made by placing the front panel on the adhesive resin layer after applying the adhesive resin on a surface of the flat panel, and wherein the flat panel has a reservoir around an edge thereof, for receiving adhesive resin overflowed from an edge of the front panel.

2. An image display apparatus according to claim 1, the apparatus comprising a cathode ray tube including:

a bulb having a flat glass panel portion comprising a flat panel for displaying an image and a glass wall formed integrally with the flat panel and extending from the edge of the flat panel substantially perpendicularly;

a flat shadow mask facing an inner surface of the flat panel, and supported with tension by a frame attached removably to an inner surface of the glass wall; and a reinforcement band fixed around the glass wall.

3. An image display apparatus according to claim 2, wherein the reinforcement band extends from the surface of the flat panel to prevent the adhesive resin from flowing out to the glass wall when the adhesive resin is applied to the surface of the flat panel.

4. An image display apparatus according to claim 1, wherein the adhesive resin has enough conductivity for preventing the flat panel from being charged.

5. An image display apparatus according to claim 1, wherein the front panel has enough conductivity for preventing the flat panel from being charged.

6. An image display apparatus according to claim 1, wherein the front panel is provided with means for reducing reflection of outside light.

* * * * *